US008684893B2

(12) United States Patent
Tang

(10) Patent No.: US 8,684,893 B2
(45) Date of Patent: Apr. 1, 2014

(54) DUMBBELL WITH ADJUSTABLE WEIGHT

(75) Inventor: Jack Tang, New Taipei (TW)

(73) Assignee: Pro TV Electronics Inc., Taipei (TW)

( * ) Notice: Subject to any disclaimer, the term of this patent is extended or adjusted under 35 U.S.C. 154(b) by 280 days.

(21) Appl. No.: 13/352,696

(22) Filed: Jan. 18, 2012

(65) Prior Publication Data

US 2013/0150217 A1 Jun. 13, 2013

(30) Foreign Application Priority Data

Dec. 13, 2011 (TW) ..... 100223514 U

(51) Int. Cl.
*A63B 21/00* (2006.01)

(52) U.S. Cl.
USPC ..... 482/106; 482/107; 482/108

(58) Field of Classification Search
USPC ..... 482/106, 107, 108, 126, 110
See application file for complete search history.

(56) References Cited

U.S. PATENT DOCUMENTS

| | | | | | |
|---|---|---|---|---|---|
| 5,102,124 | A * | 4/1992 | Diodati | ..... | 482/107 |
| 5,180,352 | A * | 1/1993 | Sreter | ..... | 482/108 |
| 5,203,753 | A * | 4/1993 | Rothhammer | ..... | 482/111 |
| 5,254,063 | A * | 10/1993 | House, Jr. | ..... | 482/107 |
| 5,281,192 | A * | 1/1994 | Nelson | ..... | 482/93 |
| 5,435,800 | A * | 7/1995 | Nelson | ..... | 482/108 |
| 5,536,227 | A * | 7/1996 | Polchek et al. | ..... | 482/93 |
| 7,087,000 | B1 * | 8/2006 | Walker | ..... | 482/107 |
| 7,794,373 | B2 | 9/2010 | Crawford et al. | | |
| 2013/0231224 | A1 * | 9/2013 | Svenberg | ..... | 482/107 |

* cited by examiner

*Primary Examiner* — Jerome W Donnelly
(74) *Attorney, Agent, or Firm* — Muncy, Geissler, Olds & Lowe, P.C.

(57) ABSTRACT

A dumbbell with adjustable weight essentially includes a handle, two first weight blocks, two second weight blocks, and two position-limiting elements. The handle has a gripping portion and two arms protruding outward from the gripping portion. The first weight blocks are removably disposed around the arms of the handle, respectively. The second weight blocks are removably disposed around the first weight blocks, respectively. The position-limiting elements abut against the second weight blocks ends, respectively. Hence, a user can adjust the total weight of the dumbbell by changing or removing the second weight blocks.

10 Claims, 5 Drawing Sheets

DUMBBELL WITH ADJUSTABLE WEIGHT

BACKGROUND OF THE INVENTION

1. Technical Field

The present invention relates to dumbbells, and more particularly, to a dumbbell with adjustable weight.

2. Description of Related Art

Home exercise has become a trend in response to changes in people's lifestyle of today. Among a wide variety of indoor exercise equipment, dumbbells are most popular for being compact and time-independent.

A conventional dumbbell is integrally formed, and its weight is constant. Hence, dedicated users are usually in possession of dumbbells of different weights; in doing so, budgets and storage pose a problem to the users. To solve the aforesaid problem, U.S. Pat. No. 7,794,373 discloses a dumbbell that allows a user to adjust its total weight. Although the dumbbell of U.S. Pat. No. 7,794,373 allows the user to change its weight as needed, its structure is too complicated to manifest ease of production and ease of use.

SUMMARY OF THE INVENTION

In view of the aforesaid drawbacks of the prior art, it is a primary objective of the present invention to provide a dumbbell with adjustable weight and allow a user of the dumbbell to change the weight of the dumbbell quickly and conveniently.

Another objective of the present invention is to provide a dumbbell with adjustable weight such that first weight blocks or first and second weight blocks can be conveniently and quickly positioned at the handle.

In order to achieve the above and other objectives, the present invention provides a dumbbell with adjustable weight, essentially comprising a handle, two first weight blocks, two second weight blocks, and two position-limiting elements. The handle has a gripping portion and two arms protruding outward from two opposing ends of the gripping portion, respectively. The first weight blocks are removably disposed around the arms of the handle and each have an opening end abutting against the gripping portion and an end opposing the opening end and penetrated by a corresponding one of the arms. The second weight blocks are removably disposed around the first weight blocks, respectively, and each have an end penetrated by a corresponding one of the arms. The position-limiting elements are disposed at the arms for abutting against the ends of the second weight blocks, respectively. Hence, a user can change the total weight of the dumbbell as needed by changing and removing the second weight blocks.

Regarding the dumbbell with adjustable weight according to an embodiment of the present invention, a thread segment is disposed at the end of each of the two arms of the handle and spaced apart from the gripping portion. The position-limiting elements are screwed to the thread segments of the arms to abut against the second weight blocks, respectively, such that the first and second weight blocks are firmly fixed to the handle.

The position-limiting elements each have a body and a blind hole penetrating one end of the body. The wall of the blind hole has a thread. After the position-limiting elements have been screwed and fixed to thread segments of the arms, the arms are no longer exposed, thereby improving the dumbbell in terms of esthetical appearance and user safety.

Regarding the dumbbell with adjustable weight of the present invention, the first weight blocks have an outer wall each, and the second weight blocks have an inner wall each. The outer wall of each of the first weight blocks and the inner wall of each of the second weight blocks correspond in shape to each other, such that the second weight blocks can be completely disposed around the first weight blocks, respectively. Preferably, a flat side of the outer wall of each of the first weight blocks corresponds in position to a flat side of the inner wall of each of the second weight blocks, thereby preventing the first and second weight blocks from rotating relative to each other.

Regarding the dumbbell with adjustable weight of the present invention, both the outer wall of each of the first weight blocks and the outer wall of each of the second weight blocks have a flat side whereby the dumbbell placed on the ground is prevented from rolling freely across the ground.

Regarding the dumbbell with adjustable weight of the present invention, each of the second weight blocks has an opening end opposite to the end of the second weight block itself. The opening ends of the second weight blocks are flush with the opening ends of the first weight blocks, respectively.

Yet another objective of the present invention is to provide a dumbbell with adjustable weight such that the dumbbell can be conveniently gripped by a user.

In order to achieve the above and other objectives, the present invention provides a dumbbell with adjustable weight, wherein an outer wall of the gripping portion of the handle has a recess whereby a user can grip the gripping portion firmly.

The detailed structures and features of a dumbbell with adjustable weight of the present invention are hereunder illustrated with an embodiment in conjunction with the accompanying drawings, so that persons skilled in the art related to the present invention can implement the present invention easily.

BRIEF DESCRIPTION OF THE DRAWINGS

The present invention is hereunder illustrated with an embodiment in conjunction with the accompanying drawings, in which.

DETAILED DESCRIPTION OF THE EMBODIMENT OF THE INVENTION

Figure 1:
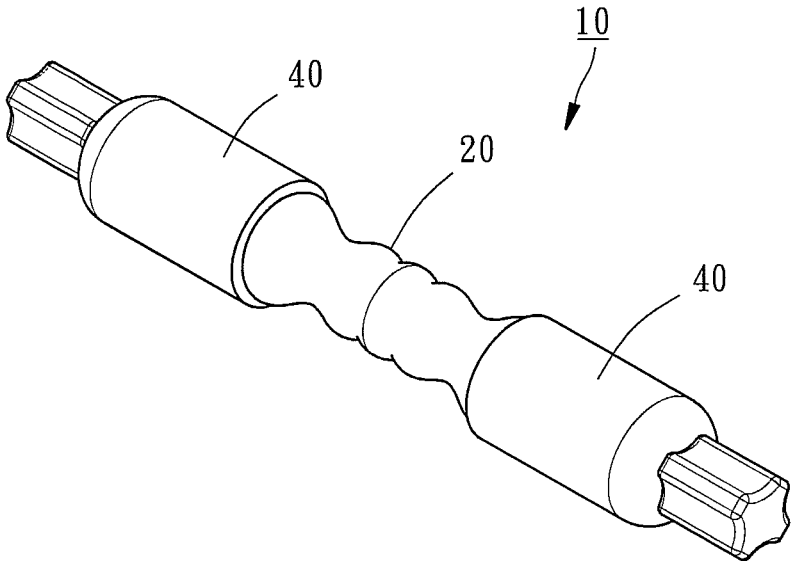
FIG. 1 is a perspective view of a dumbbell with adjustable weight according to a preferred embodiment of the present invention.
Figure 2:
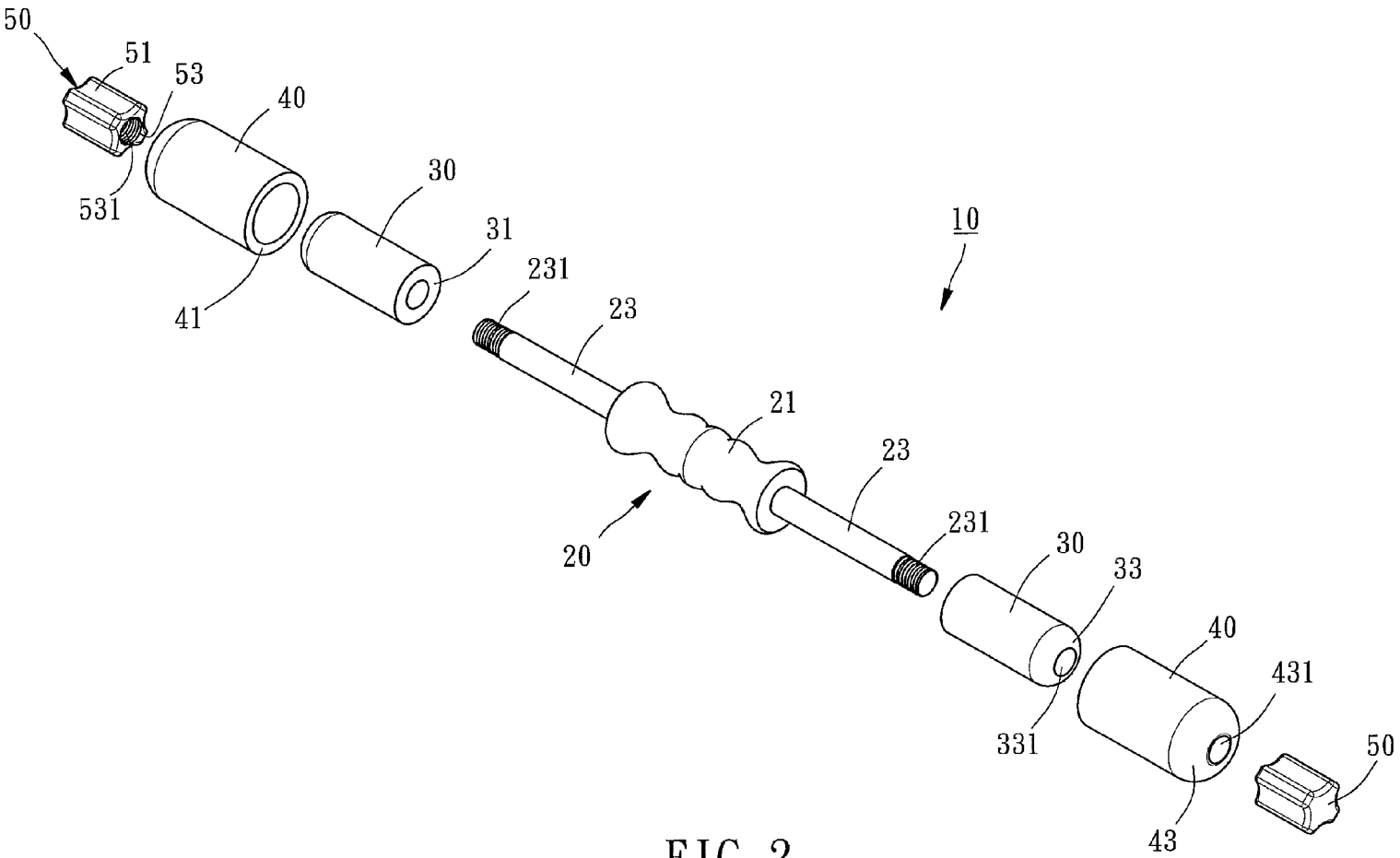
FIG. 2 is an exploded perspective view of the dumbbell with adjustable weight shown in FIG. 1, showing a handle and first and second weight blocks.

Referring to FIG. 1 and FIG. 2, a dumbbell 10 with adjustable weight according to a preferred embodiment of the present invention essentially comprises a handle 20, two first weight blocks 30, two second weight blocks 40, and two position-limiting elements 50.

Figure 3:
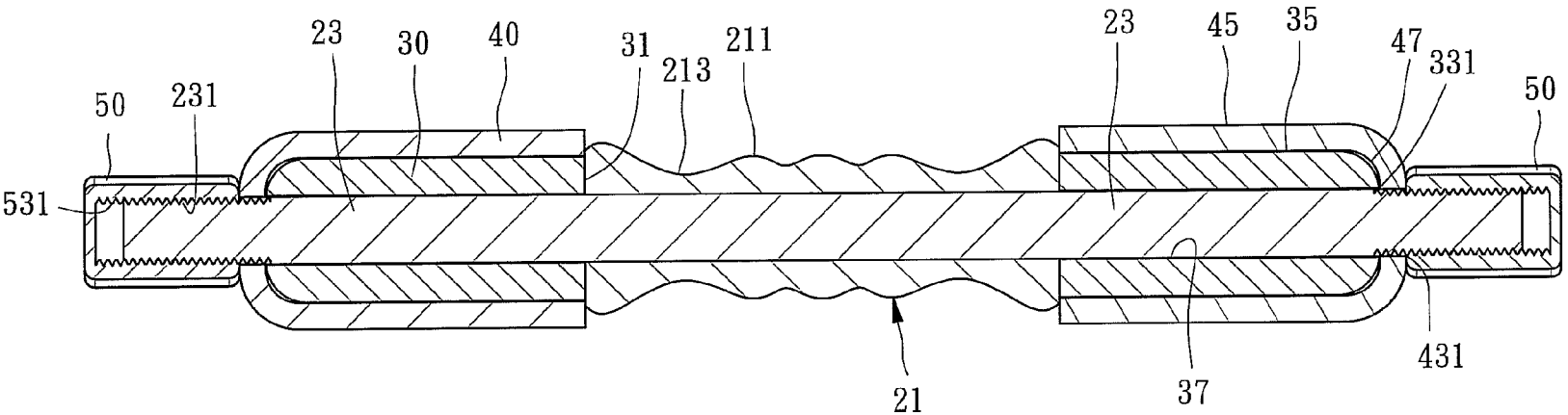
FIG. 3 is a cross-sectional view of the dumbbell with adjustable weight shown in FIG. 1, showing that the first and second weight blocks are fixed to the handle.

Referring to FIG. 1 through FIG. 3, the handle 20 has a gripping portion 21 and two arms 23 protruding outward from two opposing ends of the gripping portion 21, respectively. In this embodiment, the two arms 23 are formed from an axle penetratingly disposed at the gripping portion 21 and protruding outward from the two opposing ends of the gripping portion 21. In practice, it is feasible that the two arms 23 protruding outward from the two opposing ends of the gripping portion 21 are integrally formed with the two opposing ends of the gripping portion 21. A recess 213 is formed on an outer wall 211 of the gripping portion 21 and adapted to be gripped by a user conveniently. The outer diameter of the two anus 23 is less than the outer diameter of the two opposing ends of the gripping portion 21.

In this embodiment, the first and second weight blocks 30, 40 are cup-shaped. The first and second weight blocks 30, 40 have: opening ends 31, 41, respectively; ends 33, 43 opposite to the opening ends 31, 41, respectively; and outer walls 35, 45 and inner walls 37, 47 which are connected to the opening ends 31, 41 and the ends 33, 43, respectively. The inner diameter of the second weight blocks 40 is larger than the outer diameter of the first weight blocks 30. The outer wall 35 of the first weight blocks 30 corresponds in shape to the inner wall 47 of the second weight blocks 40. Hence, the second weight blocks 40 can be disposed around the first weight blocks 30, respectively. End holes 331, 431 are formed at the ends 33, 43 of the first and second weight blocks 30, 40, respectively.

Figure 4:
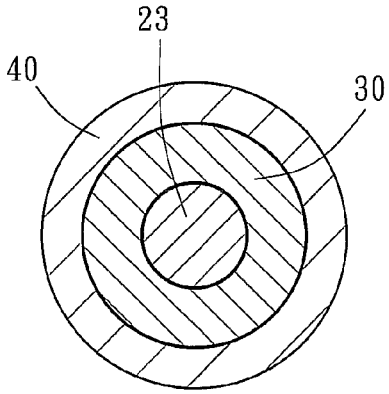
FIG. 4 is a cross-sectional view of the first and second weight blocks in one aspect.
Figure 5:
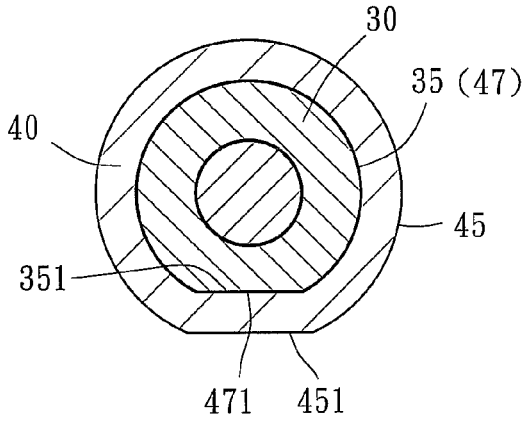
FIG. 5 is a cross-sectional view of the first and second weight blocks in another aspect.

A point to note is that the first and second weight blocks 30, 40 each have a ring-shaped cross-section as shown in FIG. 4. Referring to FIG. 5, the outer walls 35, 45 of the first and second weight blocks 30, 40 have flat sides 351, 451, respectively, for preventing the dumbbell 10 placed on the ground from rolling freely across the ground. The inner wall 47 of the second weight blocks 40 has a flat side 471 corresponding in position to the flat side 351 for preventing the first and second weight blocks 30, 40 from rotating relative to each other. Referring to FIG. 3, the assembly process of the dumbbell 10 requires putting the first weight blocks 30 around the arms 23, respectively, and then pushing the first weight blocks 30 inward until the opening ends 31 of the first weight blocks 30 abut against the gripping portion 21; meanwhile, the anus 23 protrude from the end holes 331 of the first weight blocks 30, respectively. Hence, the first weight blocks 30 can be removably disposed around the arms 23, respectively. Afterward, the assembly process of the dumbbell 10 further requires putting the second weight blocks 40 around the first weight blocks 30 in a manner that the opening ends 41 are flush with the opening ends 31, respectively; meanwhile, the arms 23 protrude from the end holes 431 of the second weight blocks 40, such that the second weight blocks 40 can be removably disposed around the first weight blocks 30, respectively. Finally, the assembly process of the dumbbell 10 further requires fixing the first and second weight blocks 30, 40 to the arms 23 with the position-limiting elements 50, respectively. Hence, the user can change or remove the second weight blocks 40 to adjust the total weight of the dumbbell 10 as needed.

There are plenty of ways of removably fixing the first weight blocks 30 to the arms 23 and removably fixing the second weight blocks 40 to the first weight blocks 30. Hence, a fixation method described below is illustrative, rather than restrictive, of the present invention.

Figure 6:
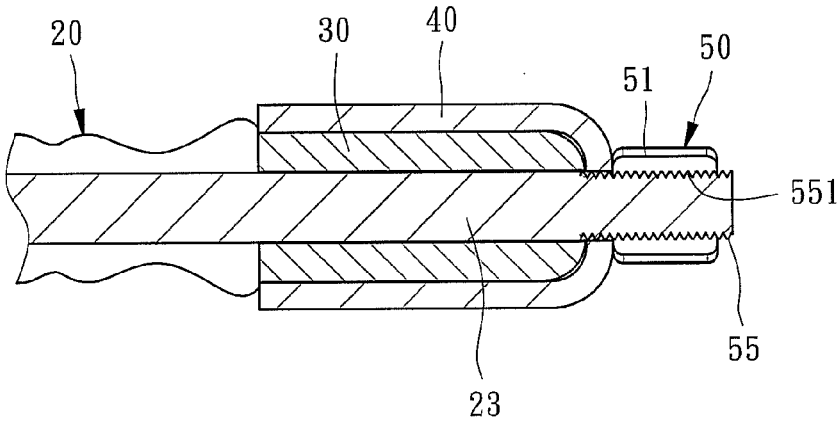
FIG. 6 is a cross-sectional view of position-limiting elements in another aspect.

Referring to FIG. 2 and FIG. 3, in this embodiment, the position-limiting elements 50 each have a body 51 and a blind hole 53 that penetrates one end of the body 51 only, wherein a thread 531 is disposed on the wall of the blind hole 53. Referring to FIG. 6, alternatively, the position-limiting elements 50 each have the body 51 and a through hole 55 that penetrates the body 51, wherein a thread 551 is disposed on the wall of the through hole 55. Referring to FIG. 3, a thread segment 231 is disposed at the end of each of the two arms 23 and spaced apart from the gripping portion 21.

To screw and fix the first weight blocks 30 to the handle 20, the user puts the first weight blocks 30 around the arms 23, respectively, and then screws the first weight blocks 30 to the handle 20 with the position-limiting elements 50, respectively. Similarly, to screw and fix the second weight blocks 40 to the handle 20, the user puts the second weight blocks 40 around the first weight blocks 30, respectively, and then screws the position-limiting elements 50 to the thread segments 231, respectively, such that the second weight blocks 40 abut against the first weight blocks 30 and are fixed to the handle 20. Referring to FIG. 2 and FIG. 3, after the position-limiting elements 50 have been screwed and fixed to the arms 23, respectively, the arms 23 are no longer exposed, thereby thereby improving the dumbbell 10 in terms of esthetical appearance and user safety.

Figure 7:
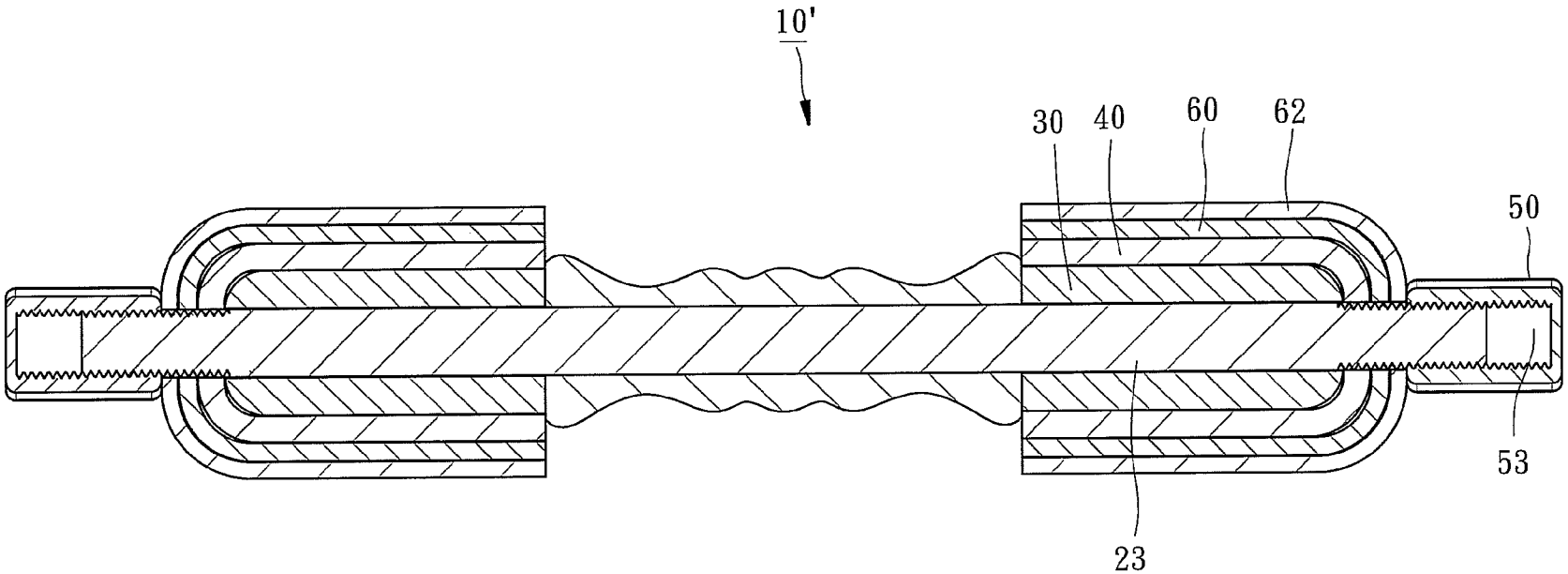
FIG. 7 is a cross-sectional view of the dumbbell with adjustable weight in another aspect, showing that the dumbbell has at least two weight blocks.

Referring to FIG. 7, unlike the dumbbell 10 which has two types of weight blocks, a dumbbell 10' with adjustable weight provided by the present invention can have more than two types of weight blocks. As shown in FIG. 7, the dumbbell 10' with adjustable weight further comprises third and four weight blocks 60, 62. The third and four weight blocks 60, 62 are similar to the first and second weight blocks 30, 40. The essential technical feature of the weight blocks 60, 62 is that the inner diameter of an outer one of the weight blocks is always larger than the outer diameter of the immediately inner one of a corresponding one of the weight blocks; hence, the weight blocks nest well. To work well with the dumbbell 10' with adjustable weight, the blind hole 53 of each of the position-limiting elements 50 has an appropriate depth such that, in the situation where the dumbbell 10' is loaded with the first weight blocks 30 only, the thread 531 disposed on the wall of the blind hole 53 of each of the position-limiting elements 50 is long enough for the first weight blocks 30 to be screwed to the arms 23, respectively.

In conclusion, a dumbbell with adjustable weight of the present invention comprises multiple weight blocks that nest and thereby enables users to conveniently adjust the total weight of the dumbbell as needed. Furthermore, a gripping portion of a handle of the dumbbell with adjustable weight has a recess for enabling users to grip the dumbbell firmly and ensuring a comfortable grip. Moreover, the weight blocks are shaped in a way to not only prevent the dumbbell from rolling across the ground freely, but also prevent the weight blocks from rotating relative to each other, thereby enhancing user safety.

What is claimed is:

1. A dumbbell with adjustable weight, comprising:

a handle having a gripping portion and two arms protruding outward from two opposing ends of the gripping portion, respectively;

two first weight blocks removably disposed around the arms of the handle, respectively, and each having an opening end abutting against the gripping portion and an end opposing the opening end and penetrated by a corresponding one of the arms;

two second weight blocks removably disposed around the first weight blocks, respectively, and each having an end penetrated by a corresponding one of the arms; and two position-limiting elements disposed at the arms for abutting against the ends of the second weight blocks, respectively.

2. The dumbbell with adjustable weight of claim 1, wherein a thread segment is disposed at each of the two arms of the handle and spaced apart from the gripping portion, and the position-limiting elements are screwed to the thread segments of the arms so as to abut against the second weight blocks, respectively, thereby allowing the first and second weight blocks to be fixed to the handle.

3. The dumbbell with adjustable weight of claim 2, wherein the position-limiting elements each have a body and a blind hole penetrating an end of the body, and a thread is disposed on a wall of the blind hole.

4. The dumbbell with adjustable weight of claim 2, wherein the position-limiting elements each have a body and a through hole penetrating the body, and a thread is disposed on a wall of the through hole.

5. The dumbbell with adjustable weight of claim 1, wherein the first weight blocks each have an outer wall, and the second weight blocks each have an inner wall, such that the outer walls of the first weight blocks correspond in shape to the inner walls of the second weight blocks, respectively.

6. The dumbbell with adjustable weight of claim 1, wherein the first and second weight blocks each have a ring-shaped cross-section.

7. The dumbbell with adjustable weight of claim 1, wherein the first and second weight blocks have an outer wall each, and the outer walls of the first and second weight blocks have a flat side each.

8. The dumbbell with adjustable weight of claim 1, wherein the first weight blocks have an outer wall each, and the second weight blocks have an inner wall each, such that the outer wall of each of the first weight blocks has a flat side and the inner wall of each of the second weight blocks has a flat side corresponding in position to the flat side of a corresponding one of the first weight blocks.

9. The dumbbell with adjustable weight of claim 1, wherein the gripping portion of the handle has an outer wall, and the outer wall has a recess.

10. The dumbbell with adjustable weight of claim 1, wherein the second weight blocks each have an opening end opposite to the end, such that the opening ends of the second weight blocks are flush with the opening ends of the first weight blocks, respectively, when the second weight blocks are disposed around the first weight blocks, respectively.

* * * * *